United States Patent [19]

Ables

[11] Patent Number: 4,526,082

[45] Date of Patent: Jul. 2, 1985

[54] ELECTRIC BOW FOR THE ELECTRIC BASS GUITAR

[76] Inventor: Charles A. Ables, 513-14th Street, NE., Washington, D.C. 20002

[21] Appl. No.: 476,132

[22] Filed: Jul. 5, 1983

[51] Int. Cl.[3] ..... G10D 3/16

[52] U.S. Cl. ..... 84/325

[58] Field of Search ..... 84/325, 326, 10, 11, 84/329

[56] References Cited

U.S. PATENT DOCUMENTS

| | | | |
|---|---|---|---|
| 873,843 | 7/1961 | Lucchesi | 84/325 |
| 3,128,664 | 7/1962 | Bango | 84/329 |

*Primary Examiner*—L. T. Hix
*Assistant Examiner*—Douglas S. Lee

[57] ABSTRACT

An illustrative characterization of the invention depicts the cone shaped bow enabling the bassist to bow one string of the electric bass guitar singularly, bow two strings simultaneously or bow three or four strings of the electric bass guitar simultaneously. The use of a cone shaped rotating bow allows the bassist to hold the bow in the right hand and play pizzicato with the forefinger. Bowing the string(s) is actuated by depressing the foot-switch and pressing the cone shaped bow against the string(s) to be bowed on the electric bass guitar. The foot-switch activates the cone shaped rotary bow to rotate clockwise between 2000 and 2400 revolutions per minute. The quality of the sound produced by this invention depends on two factors. First, the cone shaped rotary bow consists of a plastic cone that is wrapped and glued with horsehair. The cone is pressed on a grommet thereby mounting the cone to a direct current DC 6–9 volt electric motor. Factor one, the quality of the sound produced by this cone shaped rotary bow is produced by applying sufficient amounts of rosin on the cone shaped bow. Secondly, the quality of the sound produced by this invention depends on how the cone shaped bow impacts the string(s). Depressing the foot-switch activates the bow, pressure exerted on the string(s) by the bow is the means for producing different sound qualities. Factor two, less pressure exerted on the string(s) by the bow produces softer qualities of the bowed sound, increasing amounts of pressure exerted by the bow on the string(s) of the instrument produce a more intense impact.

4 Claims, 8 Drawing Figures

ELECTRIC BOW FOR THE ELECTRIC BASS GUITAR

BACKGROUND OF THE INVENTION

1. Field of the Invention

This invention relates to the electric bass guitar exclusively as means to produce a bowing sound.

2. Description of the Prior Art

Since the inception of the electric bass guitar (hereinafter referred to as the bass guitar) the use of a bow was never conceived because the instrument has always had a volume and tone control switch that enables the bassist to make the sound of the note(s) last longer, not the same effect and sound as bowing but simply making the sound of the note(s) louder thereby sustaining the sound of the note(s). In some instances the sound and volume of the note(s) can be held and sustained even longer by capturing overtones and causing overtone feedback. Overtone feedback is produced when the volume and tone controls of the bass guitar are turned to the maximum settings, coupled by turning the volume and tone controls of the amplifier to the maximum settings. Moreover, the position of the bass guitar and the amplifier must be in close proximity in order to capture these effects and to produce overtone feedback. This method produces sustained sound but the enormous volume setting requirement makes producing soft sustained note(s) impossible using the overtone feedback method.

Accordingly, there is a need for an electric bow for the bass guitar that will overcome or at least alleviate the problem associated with the prior art systems as described hereinabove and which insure producing sustained note(s) virtually at any volume or tone controll setting.

SUMMARY OF THE INVENTION

In accordance with the invention, the aforementioned difficulty with respect to sustaining soft note(s), volume and tone controls on the bass guitar make the sound of the notes last longer by turning the controls to maximum settings and using overtone feedback to produce loud sustained note(s), is to a great extent alleviated through the practice of this invention. Specifically, an embodiment of the invention comprises a cone shaped rotary bow that enables the bassist to bow singularly one different string at a time, bow two strings simultaneously, bow three or four strings simultaneously at soft, medium or loud volume and tone control settings while sustaining the note(s) bowed to an immense degree.

In addition, an embodiment of this invention includes means for activating the cone shaped rotary bow. The foot-switch controls the electrical power supply by that means activating the DC 10–16 volt electric motor in that manner activating the bow.

Moreover, an embodiment of this invention includes means for holding the bow when the bassist is not bowing. The bow holster is the means for holding the bow when the bassist is not bowing.

DESCRIPTION OF THE PREFERRED EMBODIMENT

Figure 1:
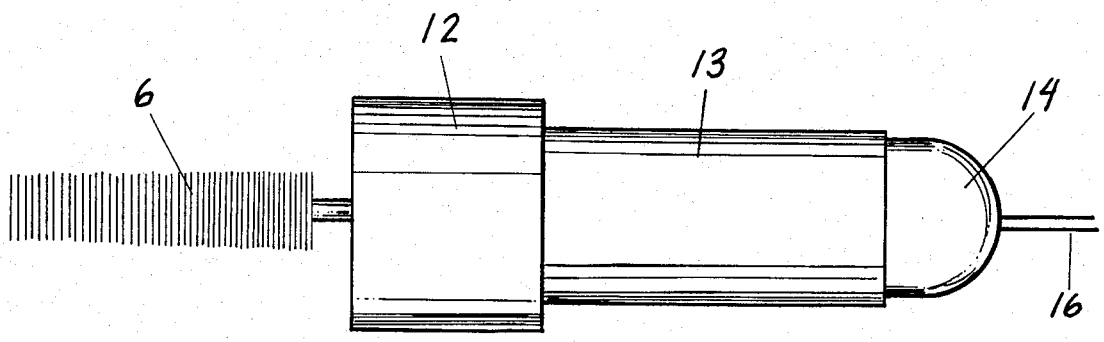
FIG. 1 is a side view illustration of the rotary electric bow.
Figure 2:
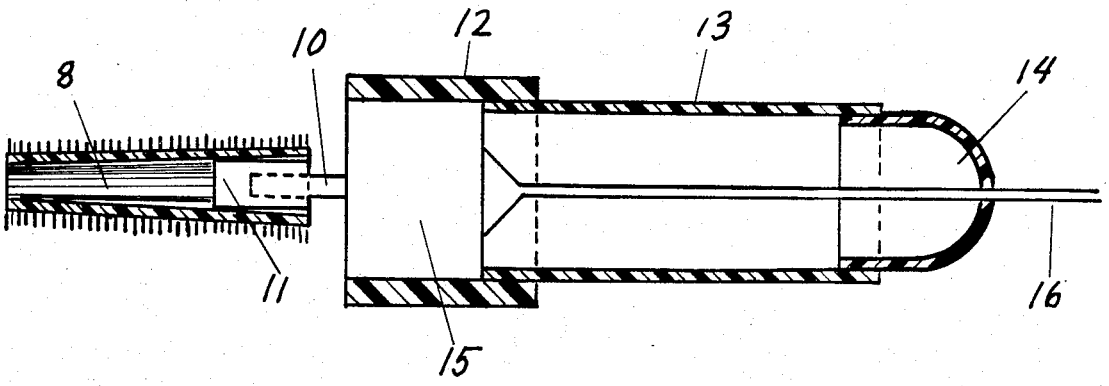
FIG. 2 is an open side view of the rotary electric bow.

The following description of an embodiment of the invention invites attention for a more complete appreciation of the invention. The rotary electric bow shown in FIG. 1 of the drawings consist of the rotary bow 6, the shaft 10, the cylinder head 12, the handle grip 13 and the tail-piece 14. Referring now to FIG. 2, the bow is made of a hard plastic cone 8, strands of horsehair are glued to the cone and the cone is glued to a plastic grommet 11. The grommet and the cone are pressed on the shaft 10 of the 6 v–9 v electric motor. The electric motor 15 is housed in the cylinder head 12 that holds the motor in a stationary position. The handle grip 13, a flexible reinforced rubber hose that serves as a passageway for the electrical wires of the motor, is pressed between the cylinder head 12 and the tail-piece 14. The tail-piece is made of plastic, it holds the electrical wires from the motor firmly in place and routes them to the foot-switch 17.

Figure 3:
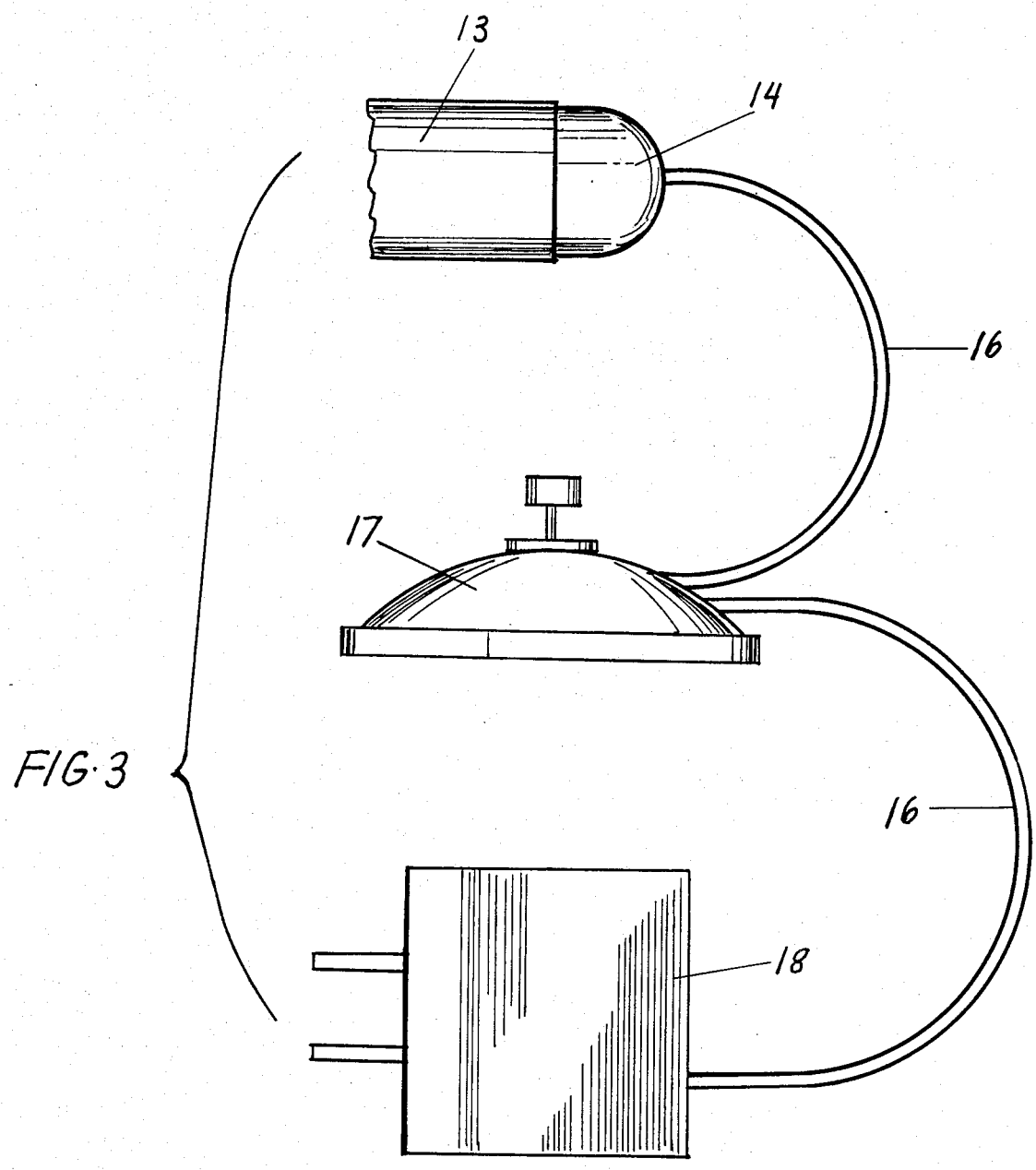
FIG. 3 depicts the electrical systematic arrangement for the apparatus of the rotary electric bow.

The foot-switch as shown in FIG. 3 actuates the bow. The switch is referred to as the foot-switch because it is operated by the bassist's foot, either the right foot or the left foot. (The actual electrical switch is not shown in FIG. 3.) The foot-switch is connected to the bow and a 6 v–9 v alternating current adapter 18. The adapter in accordance with the 6 v–9 v electric motor 15 shown in FIG. 2 is required to reduce the standard 120 volt alternating current to 6 v–9 v direct current. This type motor is used because it is quiet and compact. The foot-switch actuates the bow when the switch is depressed and will continue to actuate the bow until it is released.

Figure 4:
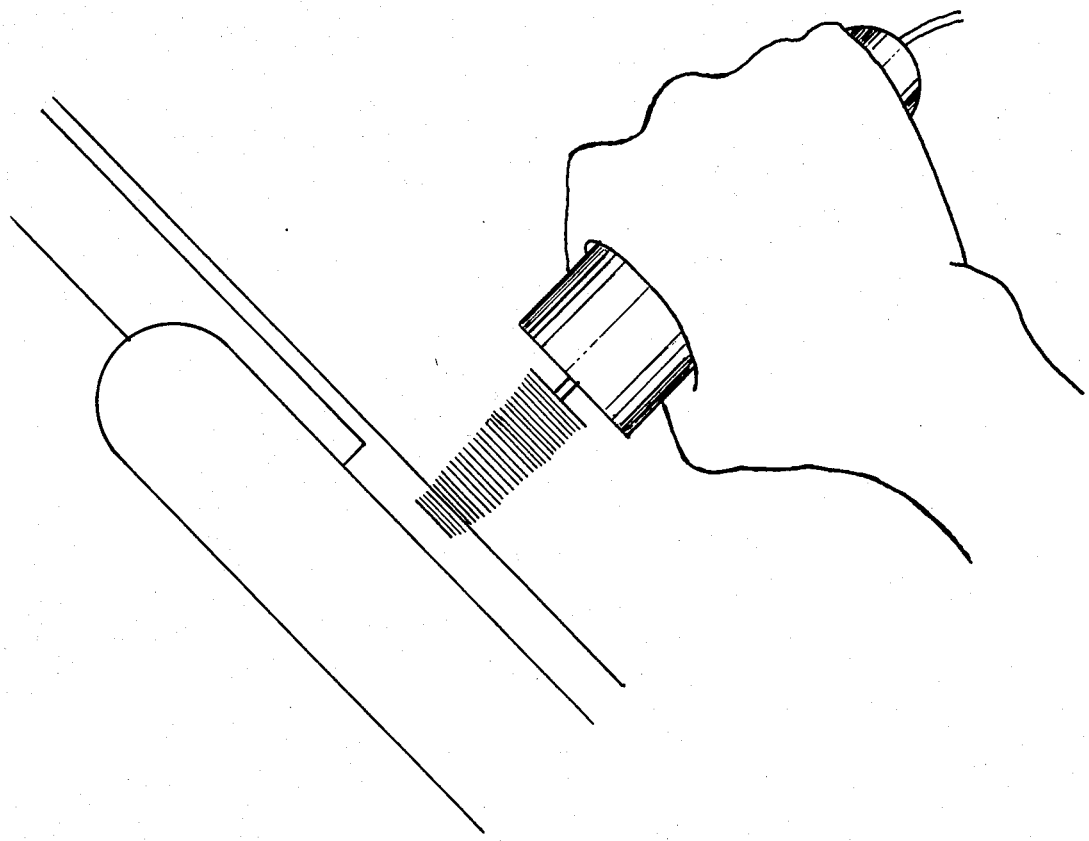
FIG. 4 illustrates how the bassist holds the rotary electric bow against the string(s) for bowing.

Referring now to FIG. 4, this illustration depicts the bassist holding the electric bow against the string(s) of the bass guitar. Bowing is actuated by depressing the foot-switch and pressing the bow against the string(s). The quality of sound produced by the bow depends on two factors. First, a sufficient amount of rosin must be put on the bow 6, FIG. 2 in order to insure that the bow will produce a dragging effect as it impacts the string(s). Secondly, sound quality produced by the bow depends on how the bow impacts the string(s). Lesser pressure exerted on the string(s) by the bow produces softer qualities of the bowed sound. Conversely, increasing amounts of pressure exerted by the bow on the string(s) produce a more intense sound.

Figure 5:
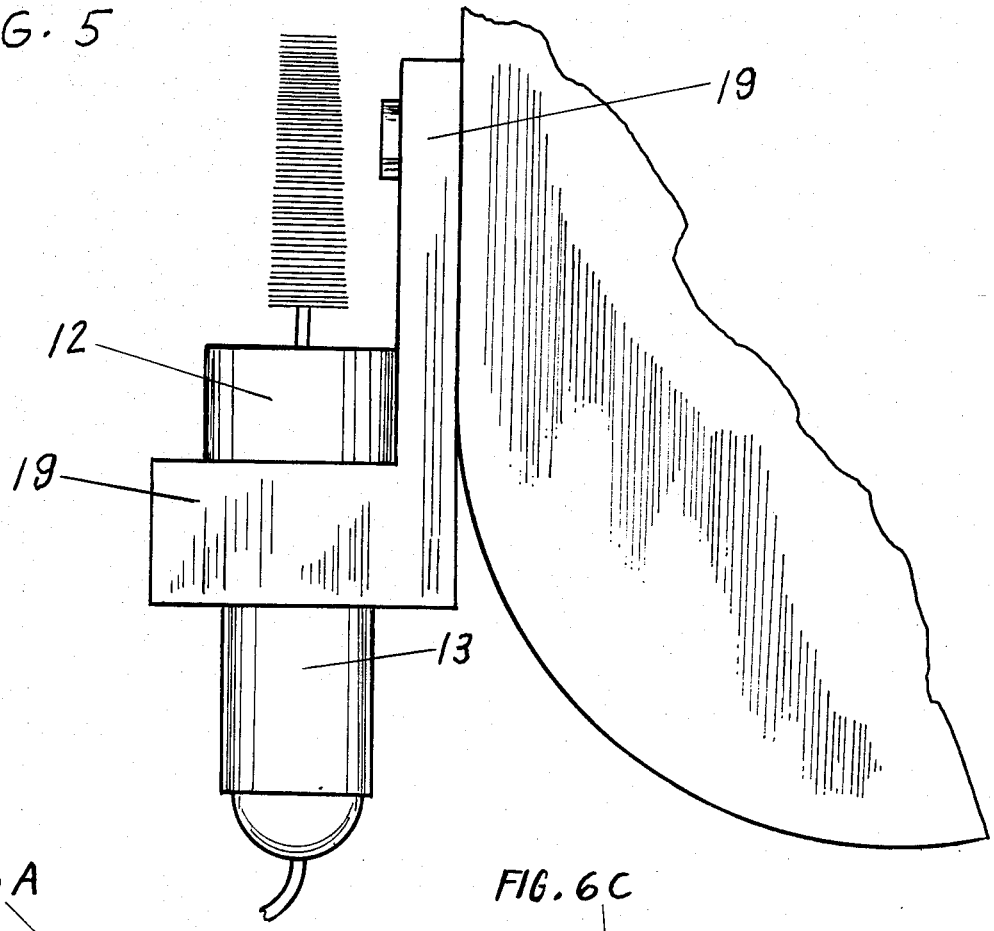
FIG. 5 illustrates the use of the bow holster for holding the bow when not in use.
Figure 6A:
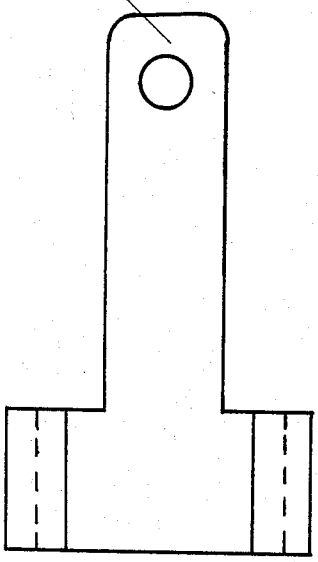
FIGS. 6A, 6B and 6C show the front, side and top view of the bow holster.
Figure 6C:
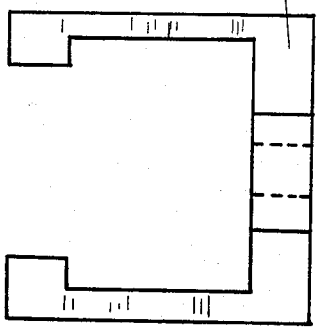
Figure 6B:
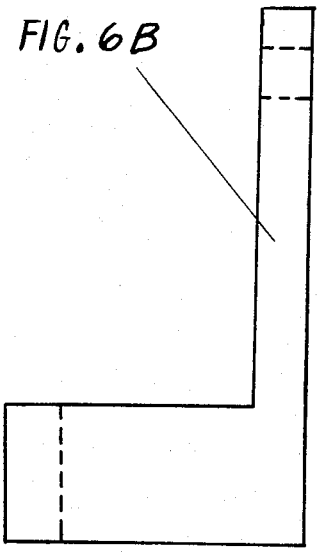

An embodiment of this invention comprises means for holding the bow when the bassist does not have to bow but wants quick and easy access to the bow. FIG. 5, illustrates the bow holster 19 attached to the bass guitar. The holster provides means for holding the bow and assuring quick and easy accessibility. The bow slips down into the holster and is stopped in a fixed position by the cylinder head 12, FIG. 2. The holster is made of plastic and has one extended arm with a hole for attaching it to the shoulder strap nut on the back side of the bass guitar. FIG. 6 shows the front 20, side 21 and top 22 view of the bow holster.

While the invention has been described in its preferred embodiment, it is to be understood that the words that have been used are words of description rather than of limitation and that changes within the purview of the appended claim may be made without departing from the true scope and spirit of the invention in its broader aspects.

I claim:

1. An electric bow device for bowing a plural stringed electric bass guitar comprising: a cylinder head housing an electric motor with rotatable shaft, a handle grip attached to said housing, and a tail piece attached to said grip, said grip and tail piece adapted to enclose electrical wiring for said motor, said handle grip adapted to be held in a hand of a user, said device being adapted for holstering when said device is not in use, a cone shaped bow means attached to said shaft of said motor, said bow means rotating when said motor is energized and said shaft is rotating, said bow means so dimensioned as to enable a user to place the bow means between two strings and bow one or both of said two strings or to place the bow means on top of said strings and bow as many as four strings.

2. An electric bow device as claimed in claim 1 further including an electrical circuit means, including an off-on control switch, connected with said motor for control thereof.

3. An electric bow device as claimed in claim 1 further including an electrical circuit means, including an off-on control switch and a 6–9 volt alternating current adapter, connected with said motor for control thereof.

4. An electric bow device as claimed in claim 1, 2 or 3 further including a holster means for said bow device, said holster means comprising arm means for supporting and holstering said device and neck means adapted to attach said holster means to a body of the bass guitar, said arm means including an opening enabling any electrical wiring extending from said tail piece to pass therethrough.

* * * * *